United States Patent [19]

Halton et al.

[11] 4,066,104

[45] Jan. 3, 1978

[54] TRIAXIAL FABRIC FORMING MACHINE AND COMPONENTS THEREOF

[75] Inventors: Murray Halton, Bryn Mawr; Norris F. Dow, Radnor; Richard M. Dow; Michael J. Hillebrand, both of Philadelphia, all of Pa.

[73] Assignee: N. F. Doweave, Inc., King of Prussia, Pa.

[21] Appl. No.: 720,627

[22] Filed: Sept. 7, 1976

Related U.S. Application Data

[62] Division of Ser. No. 522,751, Nov. 11, 1974, Pat. No. 4,015,637.

[51] Int. Cl.[2] ..... D03D 41/00

[52] U.S. Cl. ..... 139/11; 139/DIG. 1; 139/17; 139/35

[58] Field of Search ..... 139/11, 13–17, 139/DIG. 1, 35, 97, 101, 383 R

[56] References Cited

U.S. PATENT DOCUMENTS

| | | | |
|---|---|---|---|
| 1,184,790 | 5/1916 | Trautvetter | 139/17 |
| 3,719,210 | 3/1973 | Emerson et al. | 139/13 R |

FOREIGN PATENT DOCUMENTS

| | | | |
|---|---|---|---|
| 327,099 | 3/1930 | United Kingdom | 139/13 R |
| 14,098 of | 1892 | United Kingdom | 139/17 |

OTHER PUBLICATIONS

Textile Research Journal, Aug. 1971, vol. 41, No. 8, Triaxially Woven Fabrics: Their Structure and Properties, John Skelton, pp. 637–647.

*Primary Examiner*—James Kee Kee Chi
*Attorney, Agent, or Firm*—Miller & Prestia

[57] ABSTRACT

A machine for manufacturing triaxial fabrics, primarily of the type disclosed and claimed in Reissue Pat. No. 28155, comprises a vertically oriented warp yarn supply means based upon a horizontally disposed rotating creel, on which is preferably mounted a plurality of beams each supplying a plurality of warp yarn ends. Guide holders travelling on a cam-shaped track compensate for warp yarn path length changes so as to maintain path lengths from creel to weaving means relatively constant independent of angular position of an individual warp yarn in the course of the weaving process. Preferably, a multiplicity of such guides are combined on a single trolley carrier several of which are mounted at spaced intervals on the cam-shaped track, the movement of which is co-ordinated with the rotational movement of the warp yarn supply creel. Tension is maintained in the warp yarn supply by a multiplicity of individual roller guides mounted on spring arms which bend slightly to maintain tension in each warp yarn as the weaving shed is made and unmade.

2 Claims, 7 Drawing Figures

TRIAXIAL FABRIC FORMING MACHINE AND COMPONENTS THEREOF

This is a division, of application Ser. No. 522,751, filed Nov. 11, 1974, now U.S. Pat. No. 4,015,637.

This invention pertains to triaxial fabric manufacturing apparatus and particularly to a novel triaxial fabric forming machine and components thereof.

Triaxial fabrics woven or manufactured in any of a variety of ways have been known for some time. A flaccid or textile type triaxial fabric of particularly desirable physical attributes is disclosed and claimed in Reissue Pat. No. 28155, of common inventorship and assignment herewith.

A practical problem arising in the manufacture of such fabrics is the unavoidable complexity of such equipment and particularly of the warp supply which must provide for the traversal of warp yarns across the fabric width and the return traversal to the starting position.

Prior art machines, based primarily on the modification of conventional weaving technology, have consisted of vertically disposed rotating creels with a generally horizontal movement of warp yarn from the creel to the weaving mechanism and various guide arrangements for maintaining all of the warp yarns in tension regardless of their angular position on the creel. Any full scale commercial machine of this type suffers from inherent disadvantages in the floor space required due to the size of the circular creel and the horizontal distance necessary to guide yarn from such a creel into the conventional two-sheet warp yarn array common in triaxial fabric manufacture. Moreover, the angular position of an individual warp yarn on the rotating creel and its respective position in the two-sheet warp yarn array involves a warp yarn path length which changes substantially as the warp yarn traverses about the periphery of the warp yarn array. In a full size machine, the change in warp yarn path length is such that compensation by ordinary guiding means is not practical.

Having in mind these problems, it is the general object of the present invention to provide a warp yarn fabric manufacturing machine involving somewhat reduced complexity, as compared to prior art machines, and requiring less floor space than a full scale machine based on prior designs.

A further object of this invention is to provide a convenient warp yarn supply feeding mechanism for a triaxial fabric forming machine.

A still further object of this invention is to provide a warp yarn path length compensation system for maintaining relatively constant path lengths for all warp yarns traversing about the periphery of the warp yarn array in a triaxial fabric forming machine.

Another object of this invention is to provide a yarn tensioning guide useful in triaxial fabric forming machines.

Finally, it is an object of this invention to provide triaxial fabric forming apparatus involving an overall system design facilitating the manufacture of triaxial fabric on a commercial basis.

These and other objects, which will become apparent in the course of the subsequent description of the present invention, are met, briefly, by a vertically oriented triaxial fabric forming machine with a horizontally disposed rotating creel from which a plurality of warp yarns are guided downwardly into a conventional two-sheet array and triaxial fabric weaving means. Preferably, a plurality of warp yarn beams are mounted on the rotating creel. Another feature of the present invention, which also has applicability in non-vertical triaxial fabric forming machines, is a warp yarn path length compensation system based on warp yarn guides movable about a cam-shaped path having a common axis with the warp yarn supply creel, which is in turn coincident with the geometric center of the two-sheet warp yarn array entering the weaving mechanism. A multiplicity of such guides may be combined in a single guide carrier, a plurality of which travels at spaced intervals along the cam-shaped track, their travel being driven by and in unison with the rotation of the warp yarn supply creel. Such a warp yarn path length compensation system is incorporated in the vertical triaxial weaving machine in its preferred form, in accordance with the present invention.

Another component of the triaxial fabric forming machine of the present invention, which may find application outside of the present invention but which nevertheless is included in the preferred form of the present invention, is a yarn tensioner consisting of a roller guide mounted on a spring arm, the opposite end of which is statically mounted. Such a guide is disposed such that tension in the warp yarn tends to pull the spring arm away from its relaxed position. Thus with minor yarn path length changes, such as that produced by the actuation of the shed forming mechanism in a triaxial weaving machine, bending of the spring arm toward its relaxed position tends to maintain the tension in the warp yarn while correspondingly increasing slightly the path length.

This invention may be better understood by reference to the detailed description which follows, taken in conjunction with the appended claims and the drawings, in which:

Figure 1:
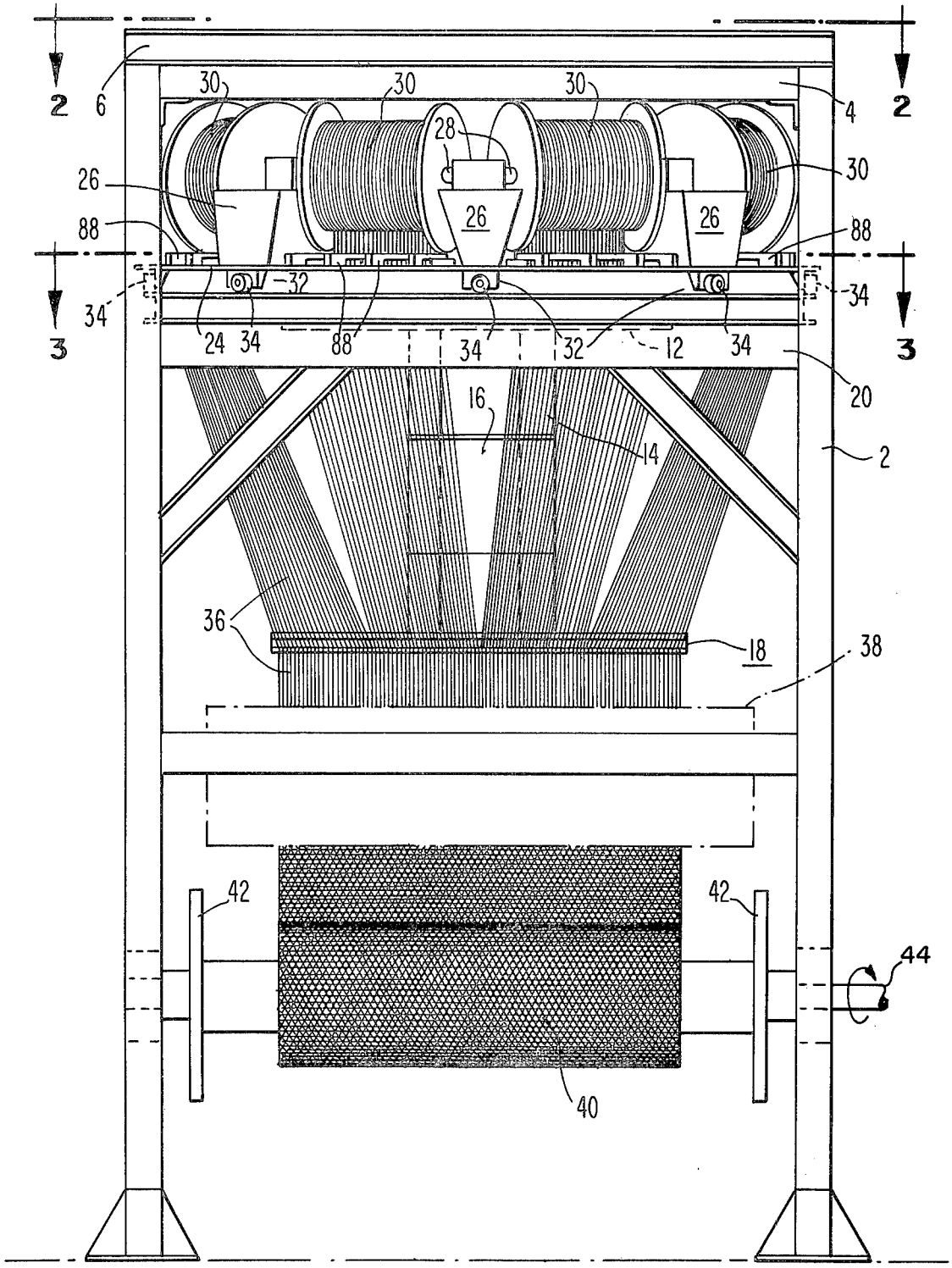
FIG. 1 is an elevation view, partially schematic, of a triaxial fabric weaving machine embodying the present invention in its preferred form.
Figure 2:
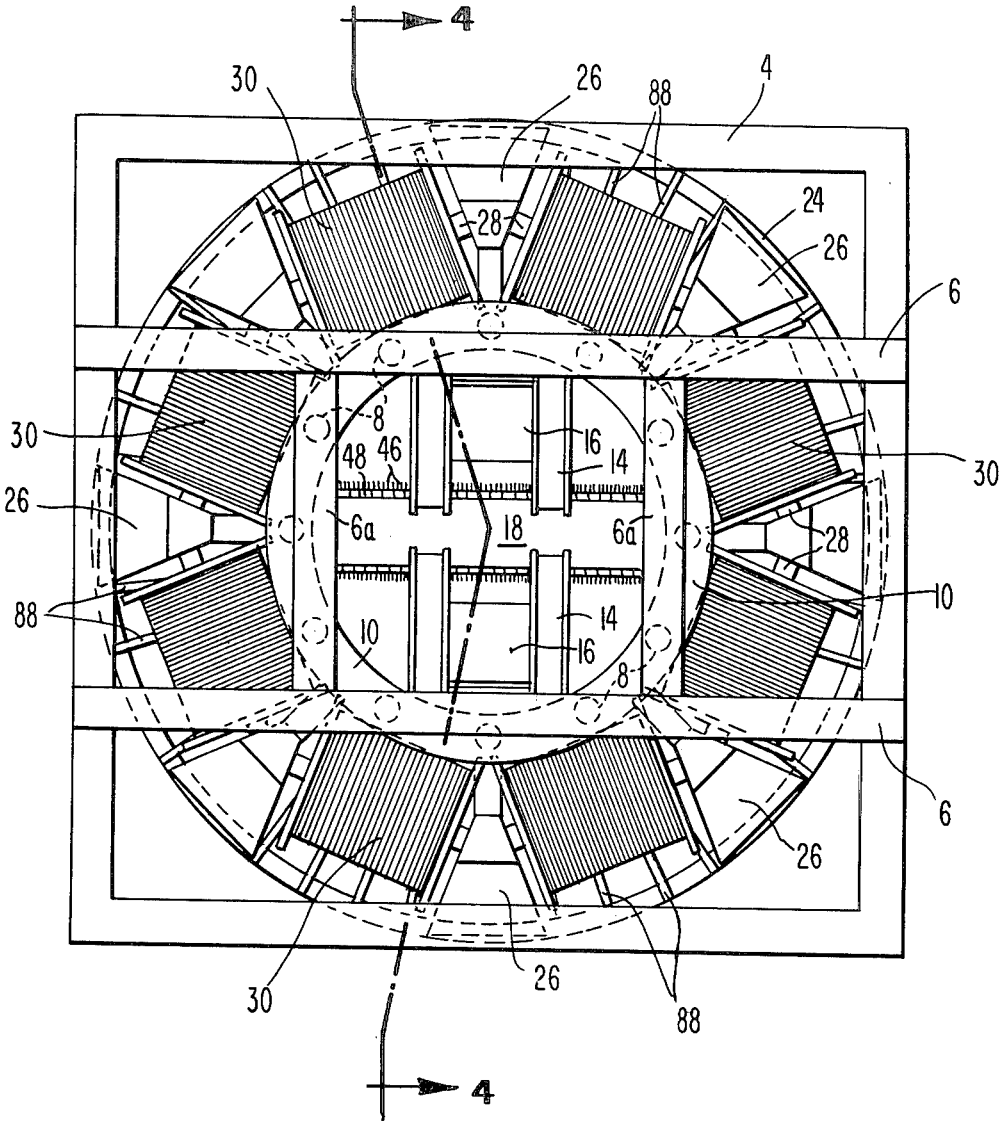
FIG. 2 is a top view of the machine shown in FIG. 1.

Referring more specifically to FIGS. 1 and 2, there is shown in one or both of these Figures vertical frame members 2, top frame members 4, top support members 6 with cross beams 6a, suspended vertical support columns 8 attached to top columns support ring member 10 and bottom columns support ring member 12 from which there is further suspended diagonal support beams 14 reinforced by plate cross member 16 and a suspended central yarn guide assembly 18. Also attached to vertical frame members 2 are horizontal creel support members 20, on which is mounted outer circular creel support member 22. Rotating creel base 24 includes, on its top side, vertical members comprising beam holders 26 with journalled shafts 28, between pairs of which are mounted warp yarn supply beams 30, each having a plurality of ends of lengths of warp yarns wrapped thereon. Creel base 24 consists generally of a horizontally disposed plate with inner and outer edges encircling the vertical axis of the machine. Openings are provided between the inner and outer edges for wrap yarns to pass downwardly from beams 30 through creel base 24.

Each beam 30 is mounted for relatively free rotation on shafts 28 with the provision of some frictional adjustment in order to control back pressure in the course of supply of yarn ends from beam 30 to other mechanisms of the overall weaving machine shown.

Attached to rotating creel base 24 through roller suspension member 32 are rollers 34, at the outer circular edge of creel base 24, which support the weight of the rotating creel associated with base 24 on outer circular creel support member 22 and permit creel rotation about the axis of the machine which extends vertically through the center of the machine.

Warp yarns from beams 30 are guided downwardly through creel base 24 and, after passing over suspended central yarn guide assembly 18, the plurality of warp yarns 36, supplied from warp yarn supply beams 30 continue their vertical downward movement, arrayed in two warp yarn sheets of generally parallel warp yarns, into a triaxial weaving means 38 (shown only in box form) generally of the type heretofore disclosed in "Preliminary Investigations of Feasibility of Weaving Triaxial Fabrics," Dow and Tranfield, *Textile Research Journal,* Vol. 40, November, 1970, and in U.S. Pat. No. 3,799,209 of common inventorship and assignment herewith. Typically, such triaxial weaving mechanisms include means for moving warp yarns in each of the warp yarn sheets transversely of the warp yarn paths (the movement in one warp sheet being opposite that in the other), means for transferring warp yarns from the edge of each sheet to the corresponding edges of the other sheet, heddles for intermittently displacing individual warp yarns perpendicularly from the plane of the warp yarn sheet, thereby forming weaving sheds and pick insertion means such as the rigid rapier pick inserter as manufactured and sold by Societe Alsacienne De Constructions Mecaniques, 1 Rue de la Fonderie, 68054, Mulhouse, France. Further included in this weaving mechanism are warp beat-up means such as the cammed warp beaters disclosed and claimed in the above referenced U.S. Pat. No. 3,799,209, the disclosure of which is incorporated herein by reference. Triaxial fabric from triaxial weaving means 38 proceed vertically downward to fabric take-up roll 40 mounted in journalled support members 42 horizontally suspended between vertical frame members 2.

Although not shown in these figures, the triaxial weaving machine illustrated obviously includes conventional drive mechanisms for rotating the rotating creel associated with creel base 24, take-up roll drive shaft 44 and for operating heddles, beaters and the pick insertion means in triaxial weaving means 38.

Figure 4:
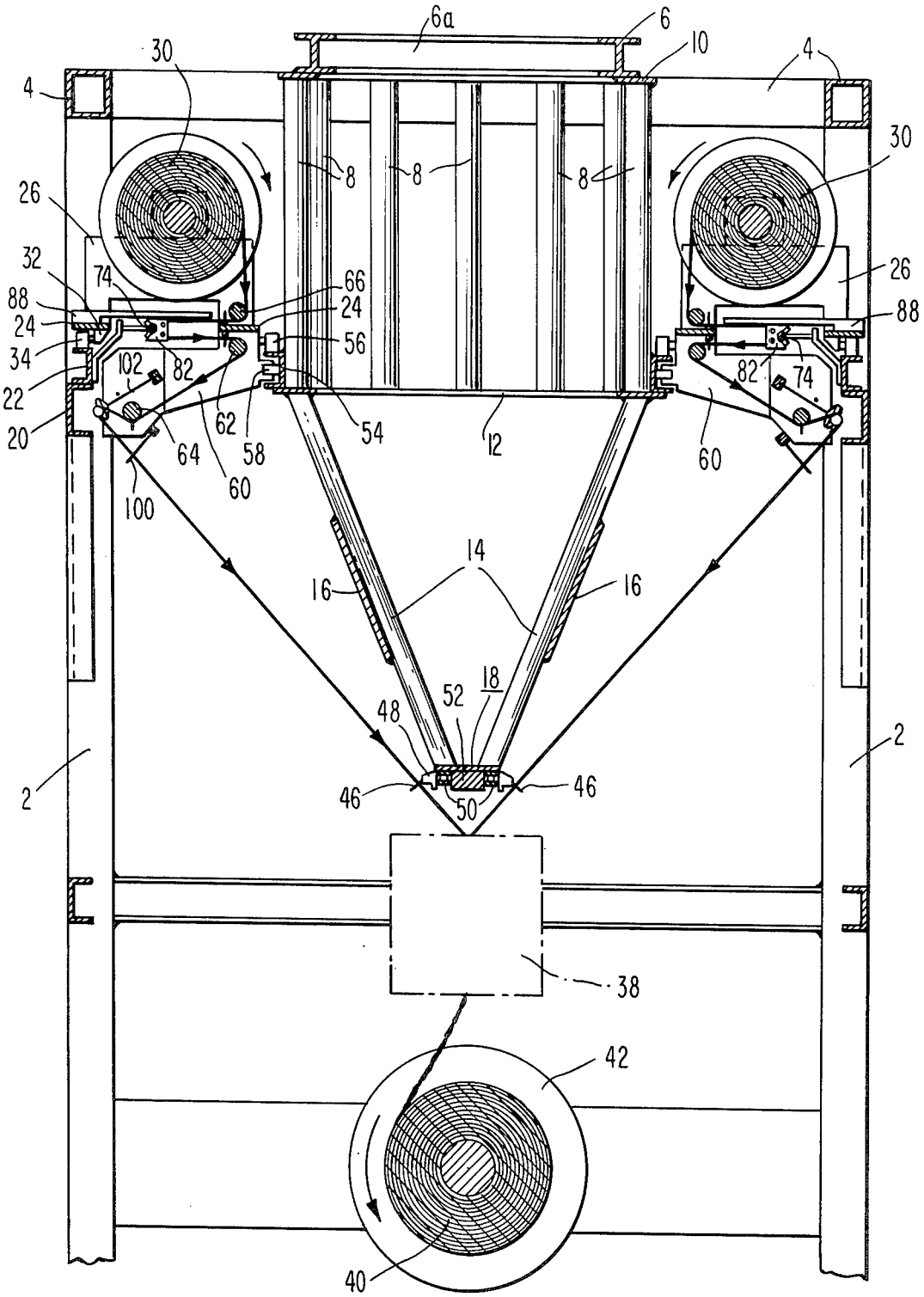
FIG. 4 is a somewhat enlarged sectional elevation view of the machine shown in FIG. 1, taken in the plane 4—4 of FIG. 2.

As best seen in FIG. 2, suspended central yarn guide assembly 18 includes movable pin guides 46, movable pin guide holders 48 and means, such as a sprocket chain 50 (seen in FIG. 4), for moving holders 48 together with pin guides 46 about the periphery of a central support bar 52 (also as best seen in FIG. 4). As previously indicated, the illustrated triaxial weaving machine further includes conventional drive mechanisms for rotating creel base 24 and its associated equipment (by the engagement of gear teeth on creel base 24). Also included is means, supported above the machine and projecting vertically down through the machine, for driving sprocket chain 50. Further included, but not shown, is means for co-ordinating the various drive means necessary in the operation of this machine.

Alternatively, (to central yarn guide assembly 18 as shown) central support bar 52 may be provided with smooth, helically grooved shafts along its two edges. The grooves in such shafts serve as warp yarn guides and the rotation of such shafts automatically advances the individual warp yarns in the two sheet arrays. The warp yarns preferably pass on the inner side of such shafts so that the rotational driving means for the shafts is located outside of the overall warp yarn array.

Figure 3:
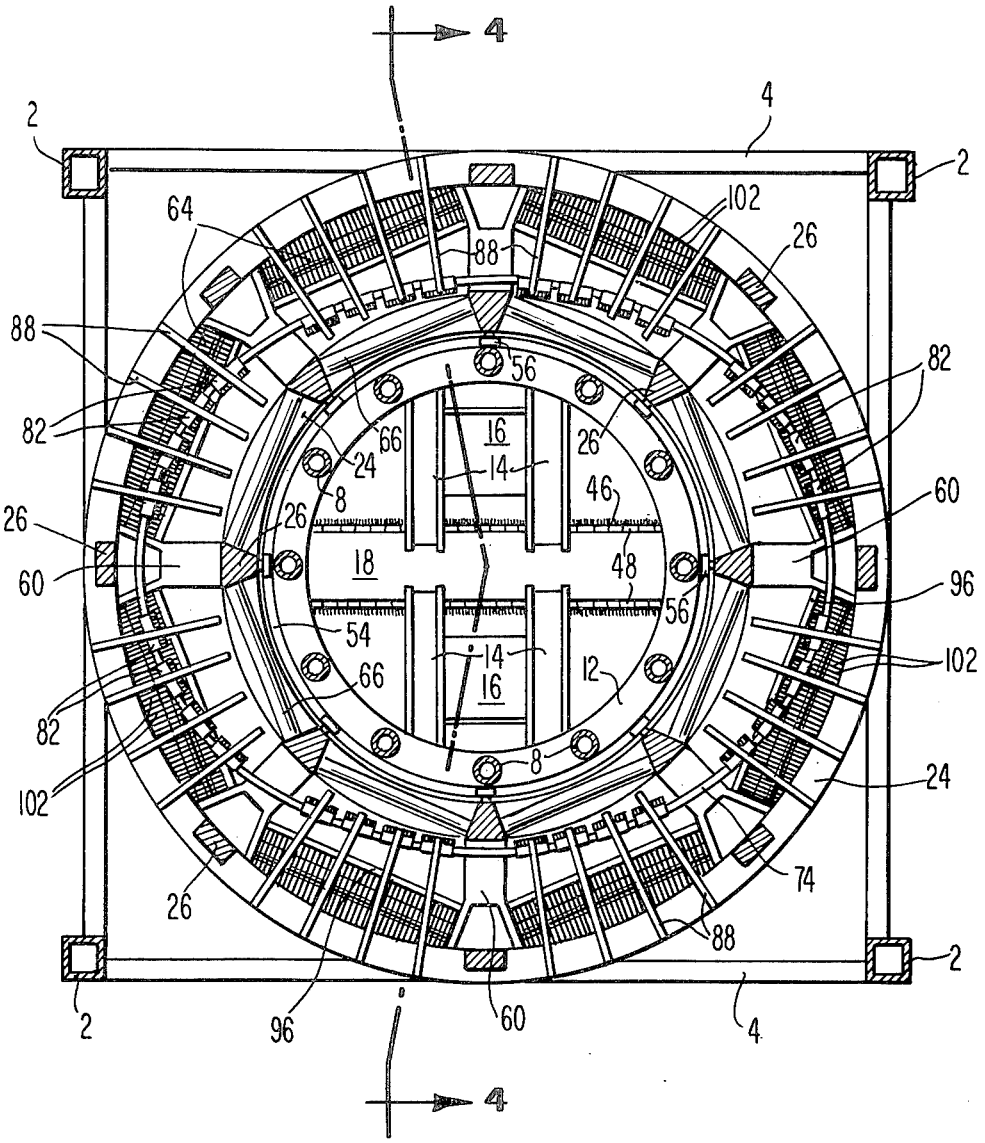
FIG. 3 is a horizontal sectional view of the machine shown in FIG. 1, in the plane 3—3 of FIG. 1.
Figures 5, 6, 7:
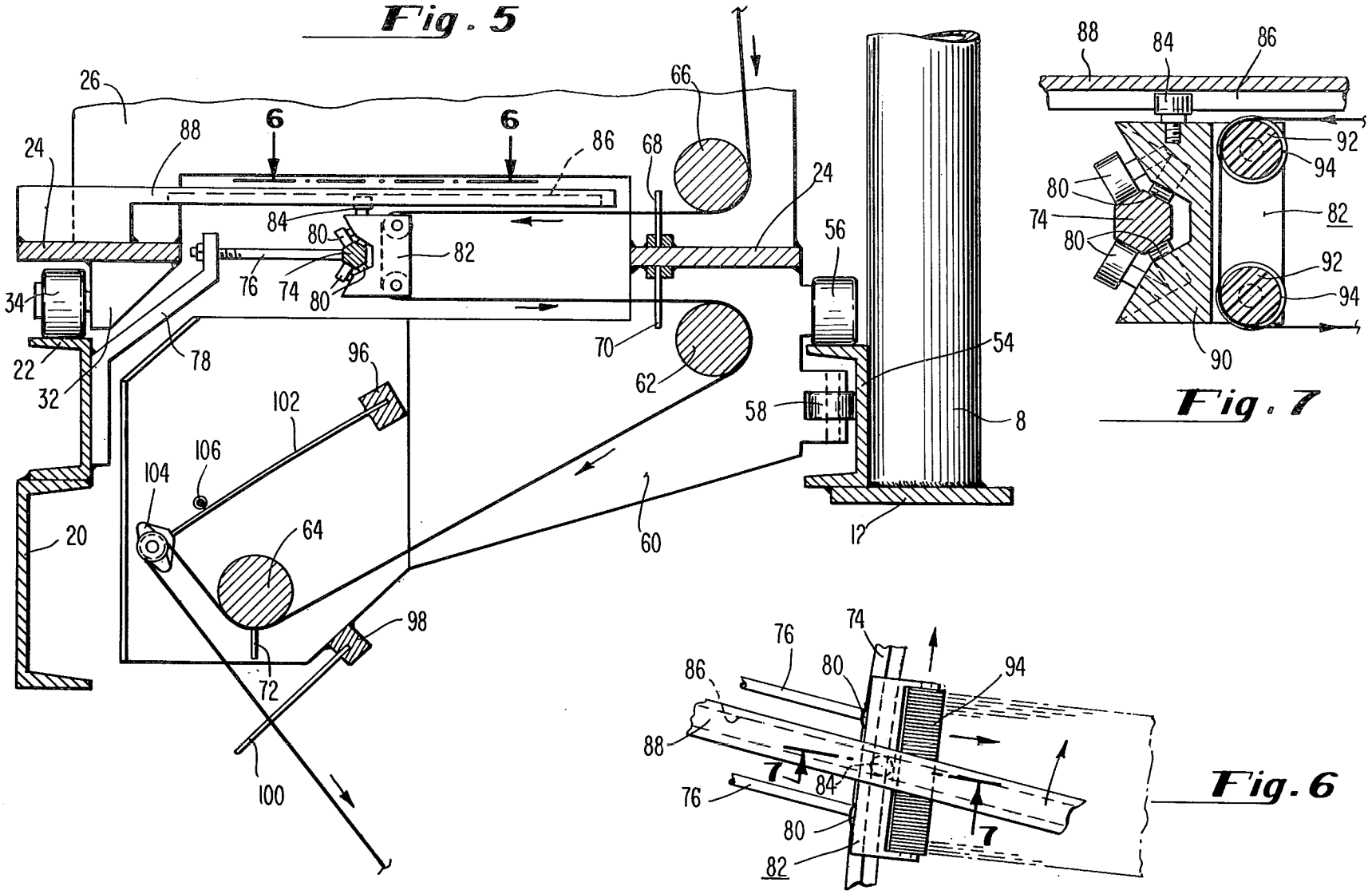
FIG. 5 is an enlarged detail view of one part of the machine shown in FIG. 4.
FIG. 6 is an enlarged detailed top view, in the plane 6—6 of FIG. 5, of one part of the machine shown in the previous figures.
FIG. 7 is an enlarged detail view, sectioned in the plane 7—7 shown in FIG. 6, of one part of the machine shown in the previous figures, and particularly that mechanism shown in FIG. 6.

As best seen in FIGS. 3, 4, and 5, the rotating creel of warp yarn supply beams 30 mounted on rotating creel base 24 is also supported in its circular movement by inner rollers 56 riding on inner edge circular support member 54 fixedly secured to suspended support columns 8 and bottom column support ring members 12. Rollers 56 and rotational roller guides 58 are mounted on spaced apart vertical members, also referred to as lower support members 60, fixedly secured to the underside of rotating creel base 14; between pairs of vertical members 60 are suspended horizontal yarn guide rods 62 and 64. Similar horizontal yarn guide rods 66 are suspended between pairs of beam holders 26 above rotating creel base 24. Laterally spaced yarn pin guides 68 and 70 are also disposed above and below rotating creel base 24. Similar laterally spaced pin guides 72 are mounted on horizontal yarn guide rod 64.

As best seen in FIGS. 3 and 5, a horizontally disposed cam-shaped track 74 defines a path about the axis of the machine and lying in a plane perpendicular thereto, horizontal in the case of the vertical machine shown. The radii, from the axis, of this path at each point along its length is selected to provide a relatively constant warp yarn path length for all warp yarns in the course of their travel from the warp yarn supply means to the weaving means. Ordinarily, this results in a geometric configuration somewhat similar to an ellipse, but which generally is not a true ellipse. The design of the geometric configuration is based purely on the consideration of the warp yarn path length at each angular position of the rotating creel and the corresponding radius or distance from the axis at which a particular warp yarn must be located in the plane of track 74 in order to maintain the warp yarn path length relatively constant as a warp yarn travels about the overall warp yarn array.

Track 74 is fixedly mounted by a plurality of bolts 76 and a track support member 78 fixedly secured to the inner surface of outer circular creel support member 22. Support member 78 and bolts 76 have been omitted in FIG. 3 in order to facilitate an understanding of that Figure.

Mounted by means of removable roller pins 89 on track 74 are a plurality of trolleys 82. Each trolley 82 further includes a cam-headed bolt support member 84 suspended from and resting in a slot 86 therefor in cantileverd trolley support members 88 fixedly mounted on the top and near the outer edge of rotating creel base 24.

As better seen in the detail views of FIGS. 6 and 7, each trolley 82 consists of a base 90, which includes means for receiving removable roller pins 80; base 90 also includes a geometric configuration such that trolley 82 with roller pins 80 is retained on track 74 but is freely rollable along track 74. Each trolley 82 further includes rollers 92, each freely rotatable and each including a plurality of circumferential grooves 94 for receiving and guiding yarn.

As best seen in FIG. 5, also suspended between pairs of lower support members 60 are additional yarn guide mounting bars 96 and 98. Yarn guide mounting bar 98 also includes laterally spaced pin guides 100.

Mounted on yarn guide mounting bar 96 are a plurality of tension spring arms 102, each with roller guides 104 at the tips thereof. Electrical contact arms 106 may also be suspended between pairs of lower support members 60 so that an electrical signal is produced when any one or more tension spring arms 102 come in contact with an electrical contact arm 106.

With respect to the operation of the machine illustrated in FIGS. 1–7, a plurality of ends of warp yarn are fed from beams 30 over guide rods 66 through pin guides 68 around roller guides 94 of trolleys 82 through pin guide 70 over guide rods 62 through pin guides 72 of guide rod 64 over roller guides 104 and through movable pin guides 46 to weaving means 38 and then, in woven form to take up roll 40. A relatively constant path distance for all warp yarn ends from beams 30 to movable pin guide 46 is maintained by the position of trolleys 82 on cam-shaped track 74. In the course of the operation of the machine, the creel, including beams 30, mounted on creel base 24 is rotated about the axis of the machine and the constant path distance of warp yarn from an individual beam to its respective position on the pin guides 46 of central yarn guide assembly 18 is maintained by the inward or outward movement of trolley 82 suspended in slot 86 of support member 88 while guided inwardly or outwardly by cam-shaped track 74 on which each trolley 82 is mounted.

Apart from path distance changes due to relative angular position of each beam 30 to corresponding pin guides 46 on central yarn guide assembly 18, smaller path length changes are effected with the making and unmaking of sheds by weaving means 38. To compensate for these minor path length changes and to maintain tension in each warp yarn, tension spring arms 102 with roller guides 104 are mounted so as to be pulled downwardly at the tips of spring arms by the tension in each individual warp yarn. Spring loading of the tension spring arm 102 with which each warp yarn is in contact permits tension in the yarn to remain relatively constant as path length is constantly adjusted to maintain spring tension in tension arm 102. In the event of dropping or breakage of any individual warp yarn, tension spring arm 102 ceases to be loaded downwardly and instead moves upward coming in contact with electrical contact arm 106, an output signal from which may be used as an indication of a dropped or broken warp yarn.

By the combined effect of pin guides 46 at central yarn guide assembly 18 and the heddle mechanisms in weaving means 38, the array of warp yarns are converted, in plan view, from a practically circular array as they leave beams 30 to an array of two sheets of warp yarns entering means 38. In the course of triaxial weaving, individual warp yarns are transferred laterally in these individual sheet arrays and are transferred from one sheet to the other as they reach the ends thereof in their lateral movement. A separate pick-up mechanism, not shown, is disposed outside of the array of warp yarns and at the end of central yarn guide assembly 18 for taking each warp yarn as it reaches the end of one of the sheet arrays and transferring it to the corresponding edge of the opposite sheet array of warp yarns. Such pick-up and transfer devices may take any of numerous forms, as suggested in the literature article and patent referenced above. The lateral transfer of individual warp yarns along the length of each of the sheet arrays may be accomplished, for example, by the peripheral movement of pin guide holders 48 mounted on a sprocket chain 50 driven between sprocket wheels, not shown, at either end of central bar 52 (or by the rotation of smooth, helically grooved guide shafts in the alternative embodiment described above).

The movement of sprocket chain 50 and the rotation of the rotating creel mounted on creel base 24, as well as that of take-up roll 40 is generally intermittent, a slight movement of each being effected after each pick insertion cycle.

From the foregoing, it can be seen that the present invention is useful in weaving triaxial fabrics, particularly those of the type disclosed and claimed in the Re-issue Pat. No. 28155. It should also be apparent that while this invention has been described with respect to a single illustrated embodiment encompassing the preferred form thereof, the invention is not limited thereto and numerous equivalent modifications, variations and modifications of this invention may be devised by those skilled in the art without departing from the true spirit and scope thereof.

The following is claimed:

1. In a method of making triaxial fabrics in which a plurality of warp yarns are guided into an array of two converging sheets of generally parallel warp yarns and move transversely, with the direction of transverse movement of warp yarns in one sheet being opposite the direction of transverse movement in the other sheet, the improvement which comprises supplying warp yarns from a circular creel mounted for rotation about a generally vertical axis while rotating the creel intermittently in timed relation with the transverse movement of warp yarns.

2. In an improved method as recited in claim 1, the further improvement wherein said warp yarns are guided downwardly from said creel into an array of two sheets in paths, the lengths of which are changed in relation to the radial position of each of said warp yarns in the course of the movement thereof about the generally vertical axis of the rotatable creel so that the length of each of said paths remains relatively constant regardless of the radial position thereof.

* * * * *